United States Patent [19]

Miyamoto

[11] Patent Number: 4,457,724

[45] Date of Patent: Jul. 3, 1984

[54] APPARATUS FOR DRIVING A SURFBOARD

[75] Inventor: Yasuhiko Miyamoto, Ohmiya, Japan

[73] Assignee: Fuji Jukogyo Kabushiki Kaisha, Tokyo, Japan

[21] Appl. No.: 281,254

[22] Filed: Jun. 15, 1981

[30] Foreign Application Priority Data

| | | | |
|---|---|---|---|
| Dec. 27, 1980 | [JP] | Japan | 55-187181 |
| Dec. 27, 1980 | [JP] | Japan | 55-187183 |
| Dec. 27, 1980 | [JP] | Japan | 55-187186 |
| Dec. 27, 1980 | [JP] | Japan | 55-187188 |

[51] Int. Cl.[3] ..... B63H 1/04

[52] U.S. Cl. ..... 440/38; 440/112; 440/89

[58] Field of Search ..... 114/270, 211, 177; 440/38, 112, 89; 417/360

[56] References Cited

U.S. PATENT DOCUMENTS

| | | | |
|---|---|---|---|
| 3,545,897 | 12/1970 | Russell | 417/360 |
| 4,019,456 | 4/1977 | Harbert | 440/89 |
| 4,174,672 | 11/1979 | Cox | 440/112 |
| 4,274,357 | 6/1981 | Dawson | 114/270 |

*Primary Examiner*—Trygve M. Blix
*Assistant Examiner*—Thomas J. Brahan
*Attorney, Agent, or Firm*—Martin A. Farber

[57] ABSTRACT

Apparatus for driving a surfboard comprising an internal combustion engine mounted on a box on rear portion of the surfboard and a water jet propelling device driven by the internal combustion engine for propelling the surfboard. The exhaust gas system and the water jet propelling device are provided in the box. A part of the jet water is used as a cooling water of the engine. The box comprises three superimposed cases having partitions, dividing the box into an exhaust gas passageway constituting a plurality of expansion chambers and passages for exhaust gases with the exhaust gas passageway defining a gas exhaust path arranged in three dimensions, thereby preventing entry of water from the outlet port through the exhaust gas passageway to the exhaust port of the engine.

13 Claims, 17 Drawing Figures

FIG. 13a
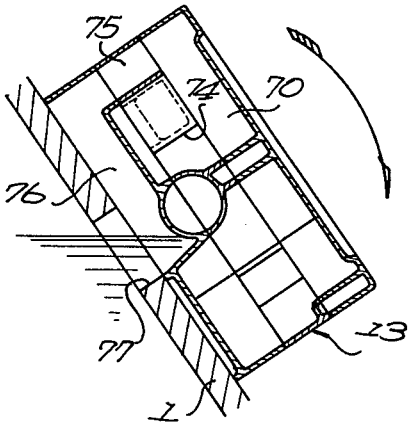
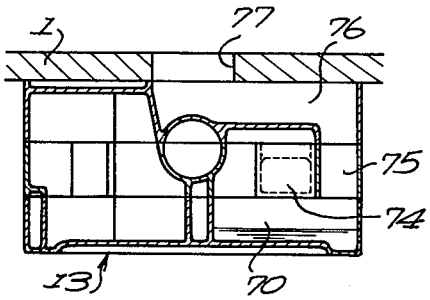
FIG. 13b
FIG. 14a
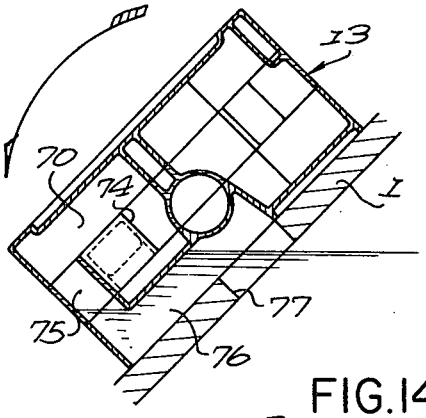
FIG. 14b
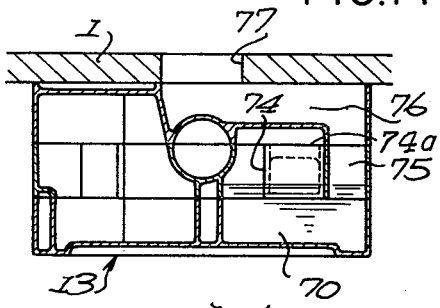
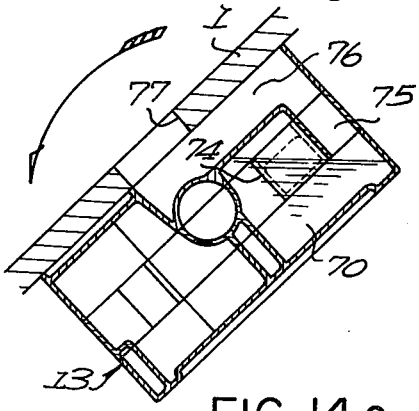
FIG. 14c

APPARATUS FOR DRIVING A SURFBOARD

BACKGROUND OF THE INVENTION

The present invention relates to an apparatus for driving a surfboard and more particularly to a water jet propelling device powered by an internal combustion engine mounted on a rear portion of the surfboard for driving the surfboard.

In recent years, although a surfboard powered by the internal combustion engine has been developed, an indeal water jet propelling device and engine and engine exhaust system have not yet been provided. For example, the engine is mounted on an engine mounting box which has sufficient buoyancy to prevent the submergence of the rear portion of the surfboard by the weight of the engine and the water jet propelling device. In such a disposition, it is preferable to provide the water jet propelling device and the engine exhaust system in the engine mounting box with a device preventing entry of water into the engine from the exhaust system, and further to provide a cooling water system for the engine in which a part of the water jet is used as the cooling water. To meet such requirements, the engine mounting box is complex in construction.

SUMMARY OF THE INVENTION

The object of the present invention is to provide an apparatus for driving a surfboard of simplified construction, which may be easily assembled and disassembled for manufacture and repair and prevents entry of water from the exhaust gas outlet port into the exhaust gas passage.

According to the present invention there is provided an apparatus for driving a surfboard comprising a box provided on a rear portion of said surfboard, an internal combustion engine mounted on said box, a crankshaft of said internal combustion engine being vertically inserted into said box, an exhaust gas passage provided in said box, said exhaust gas passage being communicated with exhaust ports of said internal combustion engine and with an outlet port provided in the underside of said surfboard, a water jet propelling device provided in said box and having an impeller connected to said crankshaft and a jet nozzle, and a cooling water system for said internal combustion engine. The box comprises three superimposed cases having partitions, dividing the box into an exhaust gas passageway constituting a plurality of expansion chambers and passages for exhaust gases with the exhaust gas passageway arranged in three dimensions, thereby preventing entry of water from the outlet port through the exhaust gas passageway to the exhaust port of the engine.

BRIEF DESCRIPTION OF DRAWINGS

FIGS. 13*a* and 13*b*, FIGS. 14*a* to 14*c* are illustrations for explaining the water entering into the exhaust passage at during rolling.

DETAILED EXPLANATION OF THE INVENTION

Figure 1:
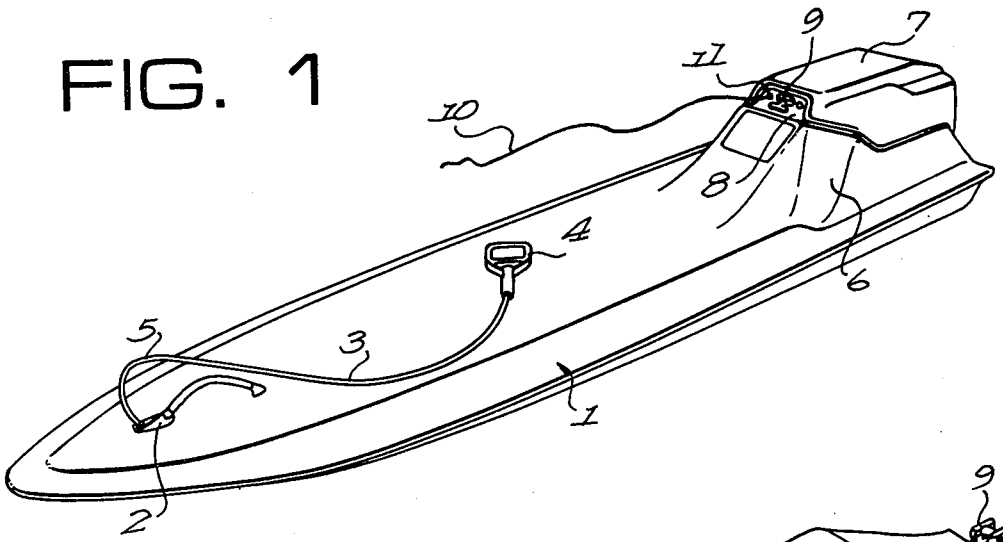
FIG. 1 is a perspective view of a surfboard to which the present invention is applied.

Referring to FIG. 1, a surfboard 1 is provided with a strong, flexible rope 3, one end of which is fixed to a front end portion of the surfboard 1 by a fixing device 2 and the other end of which is provided with a throttle handle 4. The throttle handle 4 has a grip operatively connected to an oil cylinder (not shown), so that the oil cylinder is actuated by gripping the grip to produce hydraulic pressure. The hydraulic pressure is applied through a hose 5, which is attached to the rope 3, to a carburetor of an engine. Thus, a surfer on the surfboard 1 grips the throttle handle 4 to keep himself in an upright position while tensing the rope 3. The adjustment of the gripping force applied to the throttle handle 4 causes variation of the hydraulic pressure, so that the opening degree of the throttle valve of the carburetor may be controlled, as set forth hereinafter.

Formed on the rear portion of the surfboard 1 is a protuberance 6 which is covered with a detachable hood 7 and accommodates a driving apparatus such as an engine and other members. A control panel 8 provided on the front side of the protuberance 6 has a starter knob 9 for starting the engine and a kill switch 11 adapted to be connected to the surfer by a rope 10. The kill switch is operated to stop the engine, when the rope 10 is pulled by the surfer's body when danger arises such as overturning of the surfboard.

Figure 2:
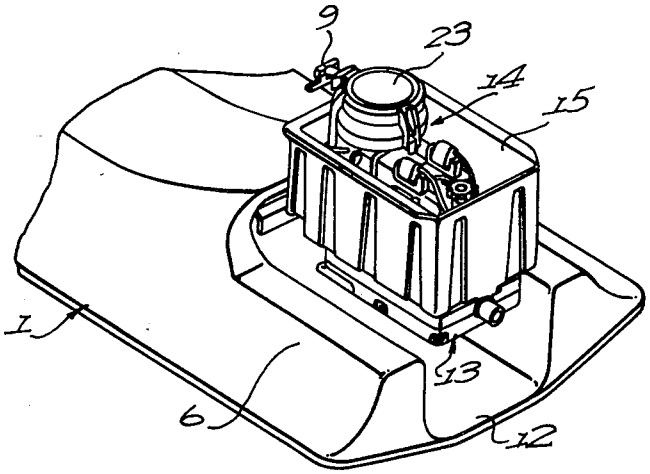
FIG. 2 is a perspective view showing a driving apparatus of the present invention.
Figure 3:
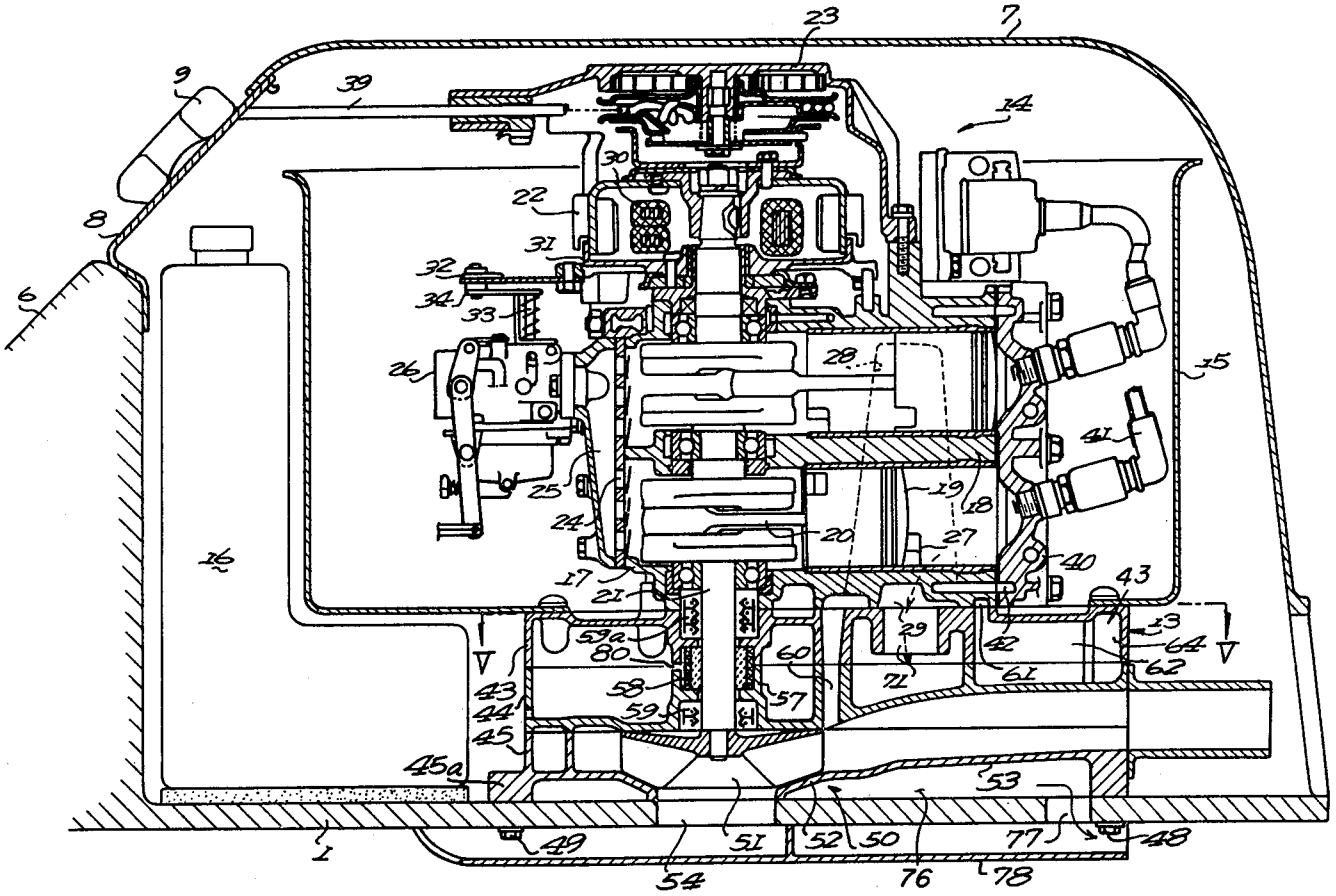
FIG. 3 is a longitudinal cross-sectional view of the apparatus of the present invention.
Figure 4:
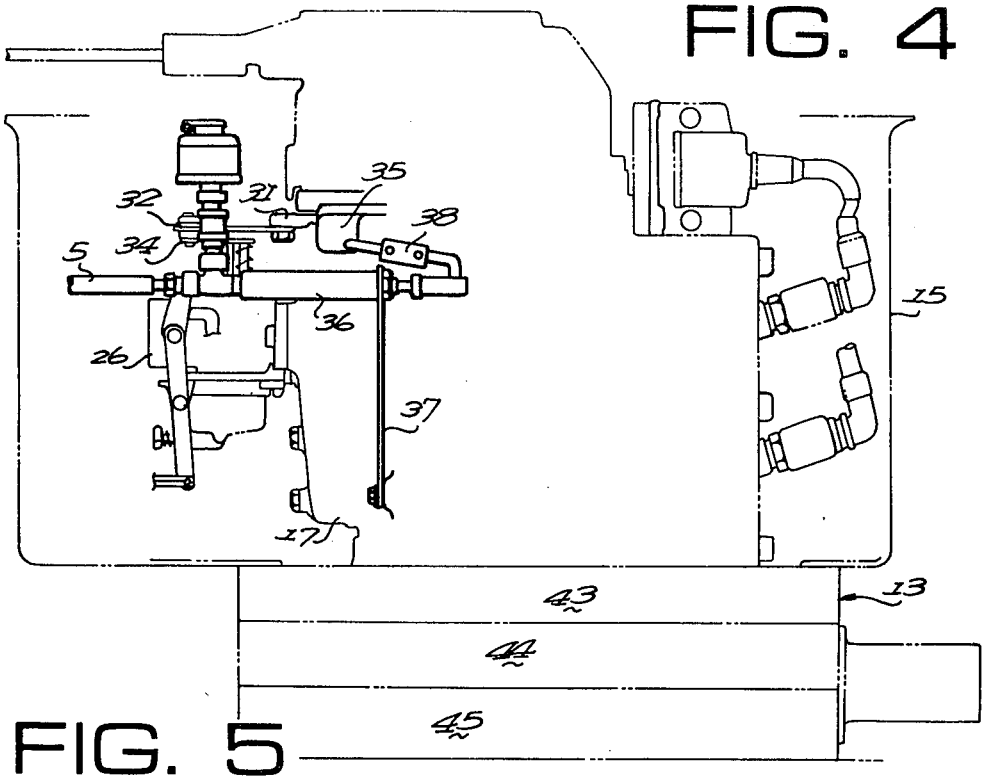
FIG. 4 is a side view showing a part of the apparatus.
Figure 5:
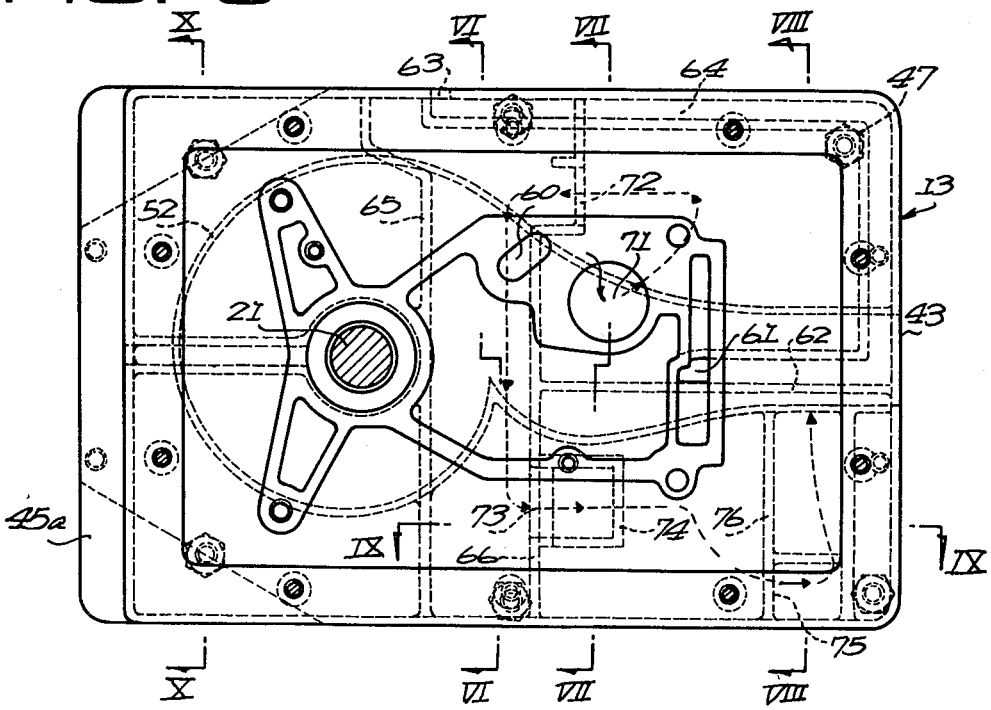
FIG. 5 is a cross sectional view taken along the line V—V of FIG. 3.

FIGS. 2 to 4, the driving apparatus is illustrated. The protuberance 6 has an accommodation room 12 which opens at the top and at the rear side to receive an engine mounting box 13 of rectangular shape. An engine 14 is horizontally mounted on the box 13 with the crankshaft being set vertical. A cover 15 of synthetic resin surrounds the engine mounting box 13 covering up to the upper portion of the engine 14 to prevent splashing of water on the engine. In the L-shaped space between the engine mounting box 13 and the cover 15, a fuel tank 16 of corresponding shape is installed as best shown in FIG. 3.

The engine as illustrated in detail in FIGS. 3 and 4 is for example, a reed valve type two-cycle two-cylinder engine, having a crank case 17 and cylinders 18 horizontally mounted and fixed on the engine mounting box 13. A piston 19 is movable in each horizontal cylinder 18. A crank shaft 21 connected to the pistons by connecting rods 20 at a lower end portion inserted into the engine mounting box 13 and at an upper end portion is provided with a magneto 22 and recoil starter 23. On the front of the crank case 17, which is the side opposite to the piston 19, there is an intake manifold 25 which communicates with the crank case 17 through reed valves 24. A carburetor 26 is attached to the intake manifold 25. Exhaust gases are lead downwardly from an exhaust port 27 opening to the rear side of the cylinder 18 to the engine mounting box 13 through an exhaust passage 29 formed by the outside of the cylinder and an exhaust manifold 28. A panel 31 having a coil 30 of the magneto 22 is mounted for a rotation for controlling the ignition timing and connected to an arm 34 integral with a throttle valve shaft 33 of the carburetor 26 through a throttle lever 32. Referring to FIG. 4 supported near an ear 35 of the plate 31 by a bracket 37 is a hydraulic cylinder 36, which is at the fore end is connected to the hose 5 and is connected at the other end to a rod 38 which in turn connected to the ear 35. Thus, the oil pressure built in the hose 5 by a tight grip on the throttle hand 4 is transferred through hydraulic cylinder 36 to the rod 38 to rotate the plate 31 to advance the ignition timing. At the same time, the throttle lever 32 causes the arm 34 of the carburetor 26 to rotate to open the throttle valve. When the grip on the throttle handle 4 is released, spring force rotates the arm 34 and the plate 31 back to the original position.

The above-mentioned starter knob 9 is connected to the recoil starter 23 through a rope 39. The kill switch 11 is adapted to actuate the electric system including the magneto 22 to cut off the ignition circuit for plugs 41. A cylinder head 40, and a cooling water passage 42 are provided.

Figure 6:
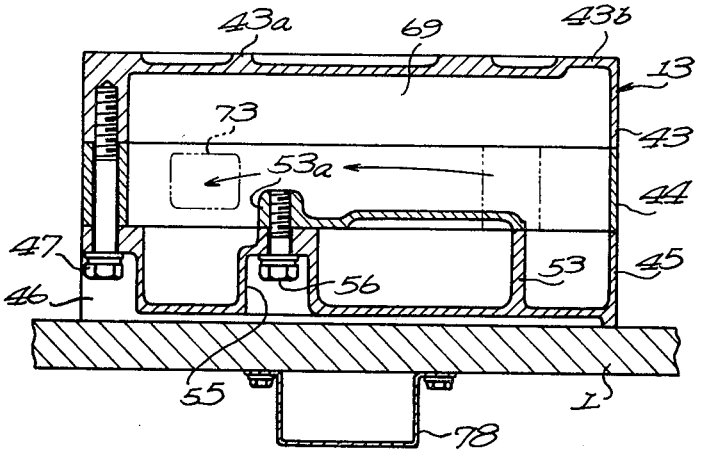
FIGS. 6–10 are cross-sectional views respectively taken along the lines VI—VI, VII—VII, VIII—VIII, IX—IX and X—X of FIG. 5.

The engine mounting box 13, as illustrated in detail in FIGS. 3, 5–14, has a superimposed construction containing an upper case 43, a middle case 44 and a bottom case 45. As shown in FIG. 6 the upper case 43 has on the upper surface thereof a mounting portion **43*a* for the engine 14 and a peripheral portion 43*b* for fixing the cover 15 thereon. At six points on the under face of the bottom case 45 there are cavities 46 for receiving bolts 47 which integrally join together the three stacked cases 43, 44 and 45. The bottom case 45 is secured to the surfboard 1 by bolts 48, at a rear portion and at a flange 45*a* projecting from the fore end and by bolts 49** which also serve as drainplugs.

Figure 7:
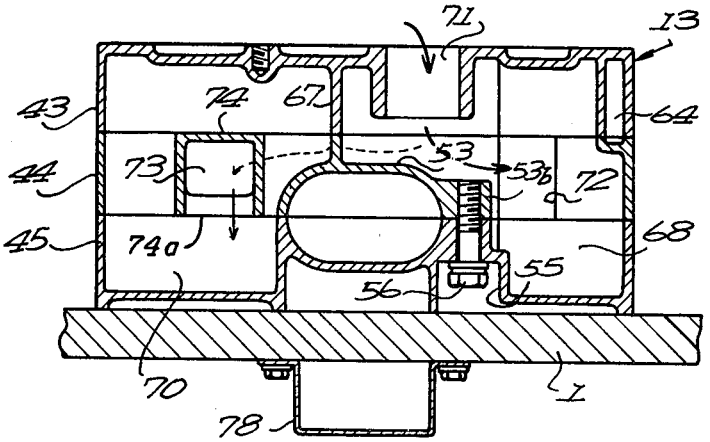
Figure 8:
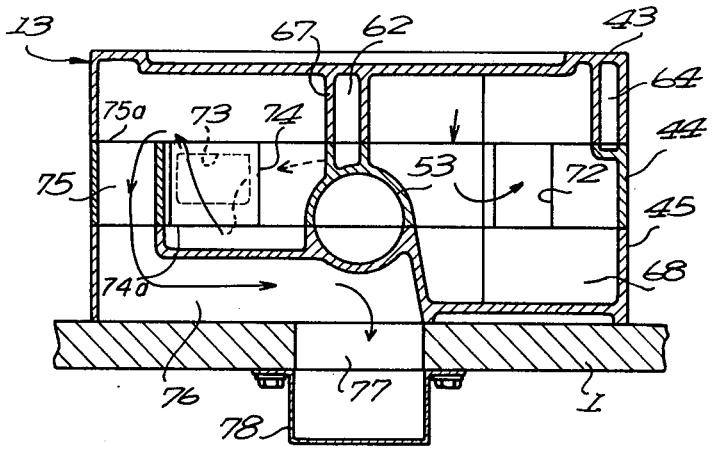
Figure 9:
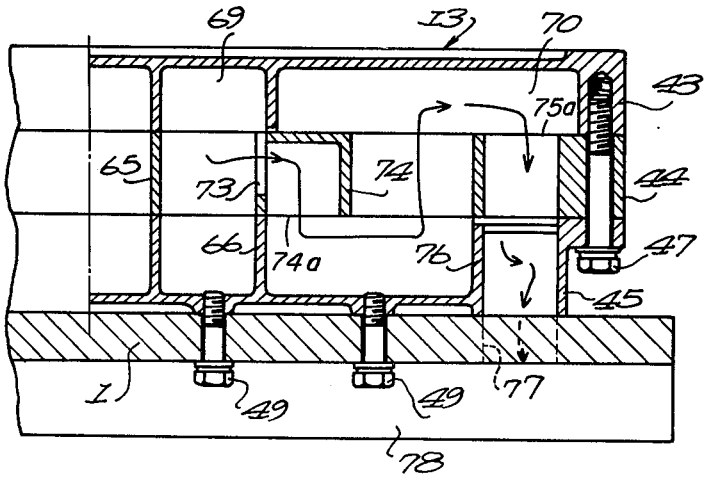
Figure 10:
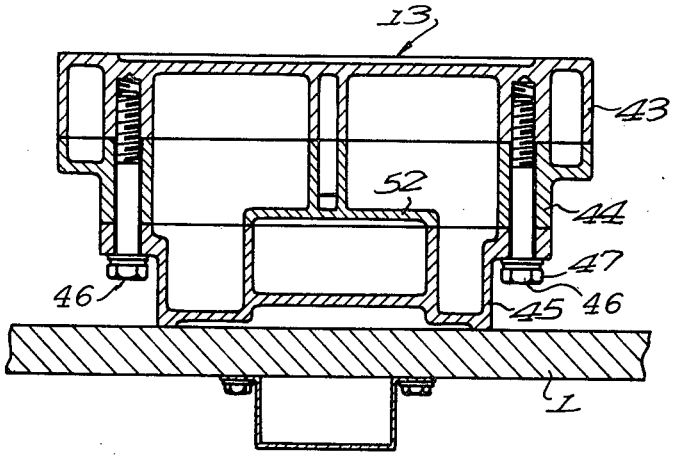
Figure 12:
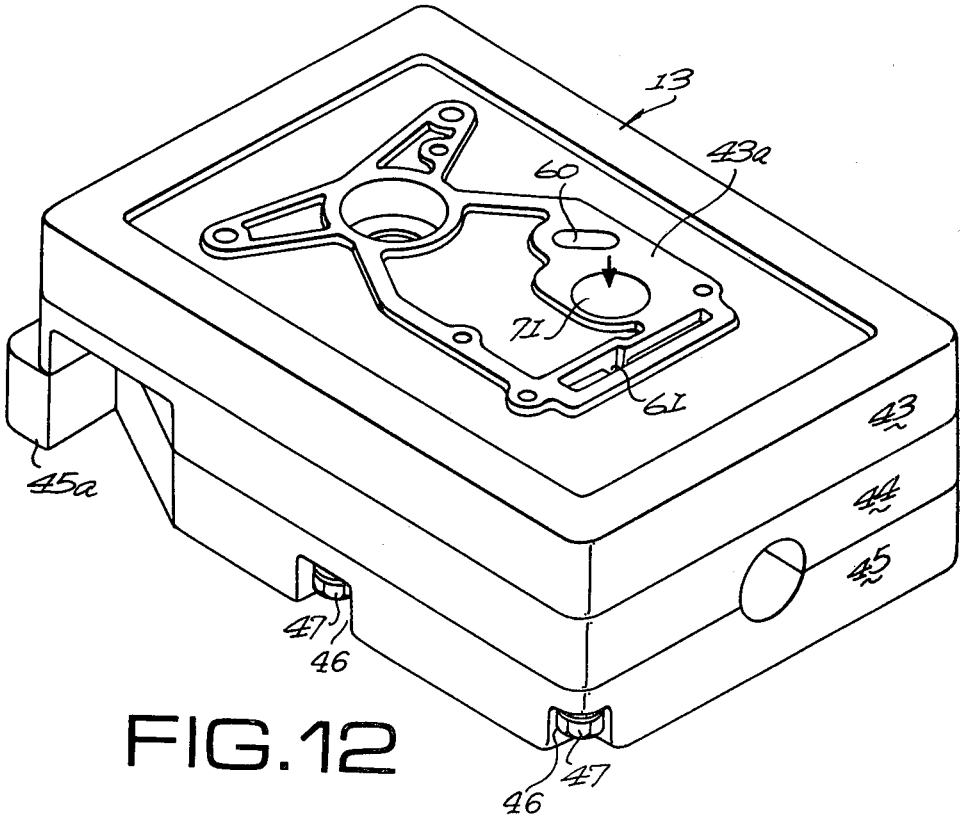
FIG. 12 is a perspective view of the engine mounting box.

By the middle and bottom cases 44 and 45, a whirl-shape case 52 for an impeller 51 of a water jet propelling device 50 connected to the crankshaft 21, and a jet nozzle 53 are formed. The case 52 communicates at a central portion thereof with a water suction port 54 which communicates with the bottom side of the surfboard 1. Considering the extremely high water pressure applied to the inside walls, flanges **53*a*, 53*b* of the nozzle 53 of cases 44, 45 are securely fastened by bolts 56 at cavities 55 of the case 45 as shown in FIGS. 6 and 7. Further, the upper and middle cases 43, 44 constitute a supporting pipe 57, through which the engine crankshaft 21 extends to be connected to the impeller 51. The engine crankshaft 21 is rotatably supported in the supporting pipe 57 by a non-lubricating plain bearing 58 and is sealed by a pair of seals 59 and 59*a* provided at opposite sides of the bearing 58 to prevent leakage of water. Further, an escape hole 80 is provided in the supporting pipe 57 for the escape of water leaking through the seal 59 and bearing 58**.

As shown in FIG. 3 the upper and middle cases 43, 44 constitute a cooling water inlet passage 60 which extends vertically from the jet nozzle 53 at one side of the impeller 51 to supply cooling water to the cooling water passage 42 of the engine 14. There are also provided a cooling water outlet passage 62 communicating with an outlet port 61 for supplying the cooling water to the periphery of the case 43 and a cooling water outlet passage 64 communicating with the cooling water outlet passage 62 to conduit the cooling water through a part of periphery of the upper case 43 out of the outlet port 63. A part of the jet stream caused by the impeller 51 flows through the cooling water inlet passage 60, the cooling water passage 42 of the engine 14, the cooling water outlet passages 62, 64 and outlet port 63.

Figure 11:
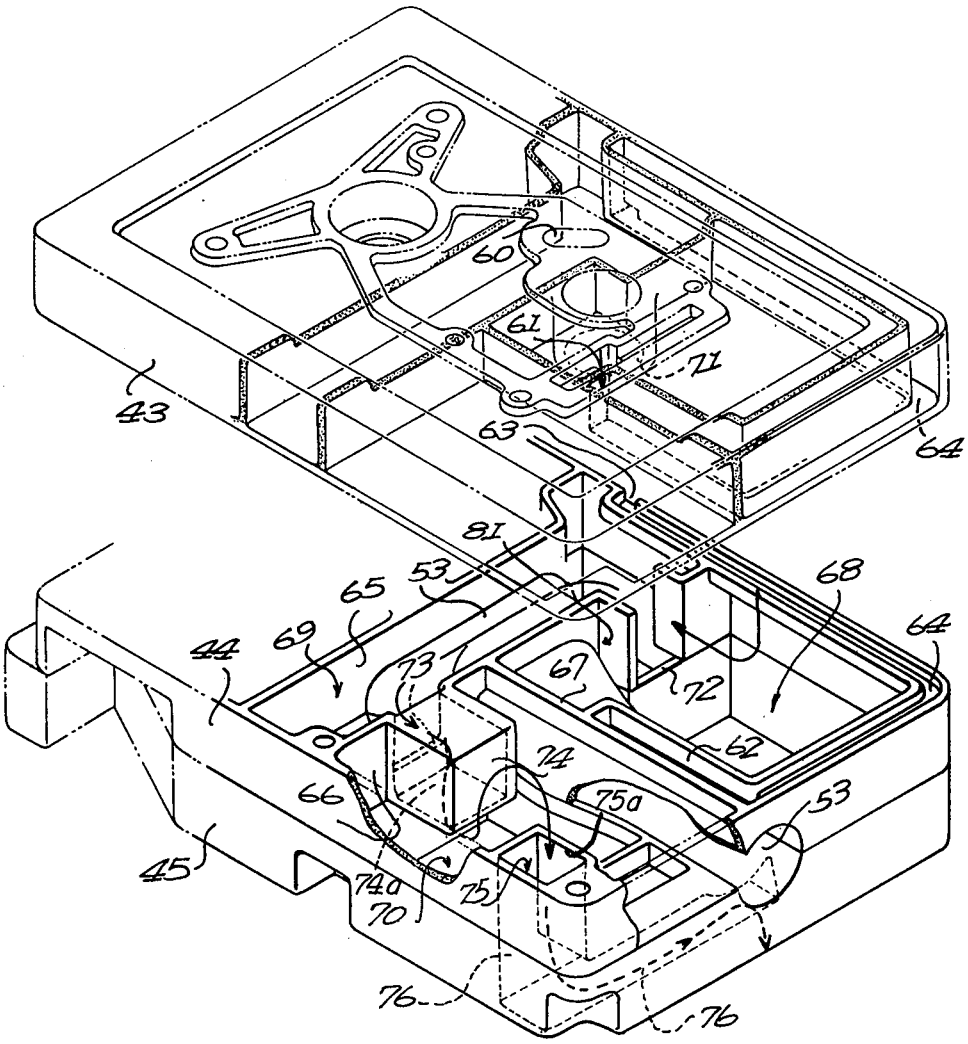
FIG. 11 is a perspective view showing an inside construction of an engine mounting box.

Further, the upper, middle and lower cases 43, 44, 45 constitute an exhaust system of the engine 14 around the jet nozzle 53. As illustrated in FIG. 11, three expansion chambers 68, 69 and 70 are formed by lateral partitions 65, 66 disposed throughout the cases 43, 44, 45 and a longitudinal partition 67 disposed through the upper and middle cases 43 and 44 on the top of the nozzle 53. An exhaust inlet port nozzle 71 provided in the upper case 43 communicates with the exhaust gas passage 29 and is inserted in the first expansion chamber 68. The first and second expansion chambers 68, 69 communicate with each other through an aperture 72 made in the partition 66 in the middle case 44; the second and third expansion chambers 69, 70 communicate with each other through an aperture 73 and a bent passage 74 having a bottom openings **74*a*; the third expansion chamber 70 communicates through a vertical passage 75 passing through the middle and bottom cases 44, 45 and a horizontal passage 76 in the bottom case 45 with an exhaust gas outlet port 77 which opens in the bottom side of the surfboard 1 immediately below the nozzle 53. Thus, by such a formation of the exhaust gas passage system arranged in three dimensions which passes from the exhaust gas inlet port 71 through three expansion chambers 68, 69, 70, through passages 75, 76 to the exhaust gas outlet port 77, water is prevented from entering inside of the engine 14** from the exhaust system when the surfboard is turned over the engine is stopped.

When the starter knob 9 is pulled taut, the recoil starter 23 is actuated to start the engine 14. In the idling condition of the engine, the output of engine is so small that the impeller 51 of the water jet propelling device 50 rotates at a very low speed. Accordingly, the waterflow passing through the water suction intake port 54, the case 52 for the water jet propelling device 50 and the nozzle 53 does not initate a jet stream, so that it is easy to hold the surfboard by one's hands and to ride on the surfboard. When a surfer on the surfboard grips the throttle handle 4, keeping balance by the rope 3, the ignition timing is advanced and simultaneously the throttle valve of the carburetor 26 opens to increase the output of the engine, which results in a high speed rotation of the impeller 51. Thus, the jet stream gushes out from the jet nozzle 53 rearwardly to drive the surfboard at a higher speed.

At the same time, a part of the jet stream flows as cooling water through the cooling water inlet passage 60, passage 42, outlet passages 62, 64 and outlet port 63. Exhaust gases leaving the engine 14 from the exhaust port 27 pass through exhaust passage 29 and enter through the exhaust gas inlet nozzle 71 into the first expansion chamber 68, through the aperture 72 into the second expansion chamber 69, then through the aperture 73 and passage 74 via its bottom exit opening **74*a* into the third expansion chamber 70, and further to exhaust gas outlet port 77 through passages 75, 76. FIG. 3 shows that passage 76 from its outlet and extends forwardly in a blind passage under the jet nozzle 53. During the flow as described, the exhaust gases, being in continuous contact with the cooled nozzle 53, are cooled and discharged safely into the water rearwardly from the bottom side of the surfboard 1 through the exhaust gas outlet port 77 and a guide 78 on the bottom of the surfboard 1**.

The expansion chambers arranged in the engine mounting box is effective for preventing water from entering as will be hereinafter described. If the surfboard 1 rolls in the clockwise direction in an engine stopped condition, the exhaust gas passages 75, 76 are positioned higher than the exhaust gas outlet port 77 and hence air is maintained in these passages 75, 76 as shown in FIGS. 13*a* and 13*b*. Therefore, water does not enter into the engine mounting box by the air lock effect. If the surfboard 1 rotates in either direction from the upside down position of FIG. 13*b*, water does not enter by the same air lock effect.

From the upright position, if the surfboard 1 rotates in the counter-clockwise direction (FIG. 14*a*), water enters into the third expansion chamber 70 passing through the exhaust gas passages 76, 75 depending on the escape of gases from the exhaust gas outlet port 77 as shown in FIG. 14*a*. Since the speed of rotation of the surfboard is considerably high, the amount of water flowing into the third expansion chamber 70 is small. The level of the water in the chamber 70 is below the horizontal opening 74*a* (now in the upper postion) of the passage 74 in the inverted condition as shown in FIG. 14*b*. Therefore, the water does not flow out of the chamber 70 through this opening. When the surfboard rotates in the clockwise direction from FIG. 14*b*, the water flows out of the chamber 70 to the outside passing through the passages in the reverse order of the above mentioned entering order. If the surfboard rotates in the counterclockwise direction from the position of FIG. 14*b*, a part of the water in the chamber 70 enters into the second expansion chamber 69 passing through the passage 74 as shown in FIG. 14*c*. Since a recess 81 (FIG. 11) is formed in the first expansion chamber 68 and the exhaust gas inlet port nozzle 71 is located at a suitable position, water does not pass through the nozzle 71 and enter into the engine.

Although there is a tendency for pressure water in the bottom case 45 to enter into the supporting pipe 57 through the seal 59, the water escapes through the hole 80.

As described above, since the water jet propelling device and the exhaust system of the engine are provided in the engine mounting box 13, the present invention provides a simple construction. Further, since the exhaust gases are cooled by the jet water and discharged from the bottom side of the surfboard, safety for the surfer and people near the surfboard may be attained.

What is claimed is:

1. An apparatus for driving a surfboard comprising a box mounted on a rear portion of said surfboard, said surfboard defines an outlet part on the bottom of said surfboard, an internal combustion engine mounted on said box, a crankshaft of said internal combustion engine being vertically inserted into said box, said internal combustion engine has an exhaust port, said box defines therein an exhaust gas passageway communicating with said exhaust port of said internal combustion engine and with said outlet port of said surfboard, a water jet propelling device disposed in said box, said water jet propelling device having an impeller secured to said crankshaft, said box defines a jet nozzle communicating with said impeller and a cooling water system for said internal combustion engine, said box comprises superimposed cases having partitions therein, said cases and said partitions dividing said box into said exhaust gas passageway constituting a plurality of expansion chambers and passages communicating in series, with said exhaust gas passageway arranged in three dimensions with reference to a central exhaust gas flow path through said plurality of expansion chambers and passages, thereby preventing entry of water from said outlet port through the exhaust gas passageway to said exhaust port of said internal combustion engine, said superimposed cases comprise a bottom case; an upper case and an intermediate case disposed between said upper and bottom cases, said partitions extend substantially vertically and constitute lateral partitions defining therebetween an intermediate second of said expansion chambers and a longitudinal of said partitions, said box, a rear of said lateral partitions and said longitudinal partition define an upstream first of said expansion chambers and a downstream third of said expansion chambers on opposite lateral sides of said longitudinal partition, said rear lateral partition is formed with first and second apertures, said first aperture communicating said upstream first and said intermediate second expansion chambers, one of said passages comprises a bent passage communicating said intermediate second and said downstream third expansion chambers via said second aperture and an exit opening of said bent passage, respectively, and another of said passages comprises a bottom laterally extending horizontal passage in said bottom case communicating with said outlet port formed in the bottom of said surfboard at the rear thereof immediately below said jet nozzle, and a vertical of said passages extends through said intermediate case to said bottom case, communicating with said downstream third expansion chamber at an upper entrance opening of said vertical passage and with said bottom laterally extending horizontal passage, respectively.

2. The apparatus for driving a surfboard according to claim 1, wherein said cooling water system communicates with said jet nozzle to provide cooling water therefrom for the engine, said cooling water system has an outlet formed in a side of said box.

3. The apparatus for driving a surfboard according to claim 1, wherein said box forms a support pipe, a pair of seals are mounted in said support pipe around said crankshaft a bearing is mounted in said support pipe, said crankshaft is disposed in said support pipe in said bearing between said seals, said support pipe is formed with an escape hole adjacent said bearing adapted for leakage of water entering into the bearing, and said escape hole communicates with said exhaust gas passageway.

4. The apparatus as set forth in claim 1, wherein each of said expansion chambers extends vertically from substantially a bottom of said bottom case to substantially a top of said upper case, said second expansion chamber extends substantially from one lateral side to the other lateral side of said superimposed cases, said upper case defines an exhaust gas inlet nozzle communicating with said exhaust port of said engine and substantially vertically extends into said first expansion chamber from the top of said upper case, said horizontal passage is at the rear of said bottom case and said horizontal passage and said second expansion chamber extend substantially parallel to each other.

5. The apparatus as set forth in claim 1, wherein said first and second apertures are formed in said rear partition and in said intermediate case, said L-bend passage extends rearwardly from said second aperture and downwardly to said exit opening of said L-bend passage and into a lower portion of said downstream third expansion chamber, said exit opening of said L-bend passage is lower than said entrance opening of said vertical passage.

6. The apparatus as set forth in claim 5, wherein said exit opening of said L-bend passage is substantially at an interface plane between said bottom and said intermediate cases, said entrance opening of said vertical passage defines a plane substantially located at an interface plane between said intermediate and said upper cases, said vertical passage extends to said horizontal passage, said horizontal passage has a vertical extent extending from a top of said surfboard to a height lower than a top of said bottom case.

7. The apparatus as set forth in claim 1, wherein said jet nozzle is formed by said bottom and said intermediate cases and extends longitudinally of said surfboard through said intermediate expansion chamber substantially from a bottom of the latter and a bottom of said bottom case and through said downstream third and said upstream first expansion chambers substantially with respective halves of said jet nozzle in said downstream third and said upstream first expansion chambers with said longitudinal partition longitudinally extending from an upper portion of said jet nozzle.

8. The apparatus as set forth in claim 7, wherein said horizontal passage at the rear of said bottom case extends laterally from said vertical passage to said outlet port under said jet nozzle as well as extending therefrom longitudinally under said jet nozzle in a blind passage.

9. The apparatus as set forth in claim 7, wherein said cooling water system includes a U-shaped outlet passage on lateral sides and the rear of said upstream first expansion chamber.

10. The apparatus as set forth in claim 9, wherein said cooling water system communicates with said jet nozzle to provide cooling water therefrom for the engine, said cooling water system has an outlet formed in a side of at least one of said upper and intermediate cases, said U-shaped outlet passage is formed in said upper case and an upper portion of said intermediate case.

11. The apparatus as set forth in claim 1, wherein said rear partition forms a recess in said upstream first expansion chamber between said longitudinal and said rear partitions and said first aperture, said upper case defines an exhaust gas inlet nozzle communicating with said exhaust port of said engine and substantially vertically extends into said first expansion chamber from the top of said upper case downwardly towards said recess to a level higher than said first aperture.

12. The apparatus as set forth in claim 1, further comprising means comprising securing bolts extending into said expansion chambers for securing a bottom of said bottom case to said surfboard and constituting drainplugs.

13. The apparatus as set forth in claim 12, further comprising flange connecting means for securing said upper and intermediate cases to each other.

* * * * *